US007387583B2

(12) United States Patent
Hochstrasser

(10) Patent No.: US 7,387,583 B2
(45) Date of Patent: Jun. 17, 2008

(54) ROLLABLE, STACKABLE TWO-PART BALL

(76) Inventor: Alex Hochstrasser, Seefeldstrasse 178, 8008 Zurich (CH)

( * ) Notice: Subject to any disclaimer, the term of this patent is extended or adjusted under 35 U.S.C. 154(b) by 0 days.

(21) Appl. No.: 11/312,003

(22) Filed: Dec. 19, 2005

(65) Prior Publication Data

US 2006/0135299 A1 Jun. 22, 2006

Related U.S. Application Data

(60) Provisional application No. 60/638,307, filed on Dec. 20, 2004.

(51) Int. Cl.
*A63B 43/04* (2006.01)

(52) U.S. Cl. ..... 473/570; 473/594

(58) Field of Classification Search ..... 473/570, 473/594, 595; D21/707, 713; 273/109, 118 R; 446/269

See application file for complete search history.

(56) References Cited

U.S. PATENT DOCUMENTS 493,941 A * 3/1893 Nembach, Jr. ..... 273/109
996,458 A * 6/1911 Coleman ..... 473/594
1,686,124 A * 10/1928 Browser ..... 273/109
2,277,057 A * 3/1942 Bach ..... 473/570
2,301,506 A * 11/1942 Bean ..... 473/594
2,524,546 A * 10/1950 Sinclaire ..... 473/570
4,822,044 A * 4/1989 Perkitny ..... 273/109
5,041,049 A * 8/1991 Wax ..... 446/289
6,056,622 A * 5/2000 Chung ..... 473/594
6,645,101 B1 * 11/2003 Wong ..... 473/594

* cited by examiner

*Primary Examiner*—Steven Wong
(74) *Attorney, Agent, or Firm*—Integral Patent Associates; Laurence J. Shaw

(57) ABSTRACT

A play object consisting of a larger ball with an open, substantially spherical-section cavity into which a smaller ball fits snuggly, yet is easily removable and re-insertable due to the diameter of the rim of the cavity being slightly smaller than the diameter of the smaller ball. The rim of the cavity is rounded. When the smaller ball is positioned in the cavity, it protrudes to roughly the spherical boundary defined by the larger ball to allow the combination to roll. When the smaller ball is removed from the cavity, the smaller ball is rollable, and the larger ball is relatively stable when placed on a flat surface with the cavity side down. Furthermore, multiple larger balls oriented with the cavity side downwards may be stacked. The balls are preferably soft, and their surfaces can be smooth, ribbed or furry. Ribbed larger balls provide the advantages of facilitating stacking, and obscuring deviations in the trueness of rolling produced by the lip of the cavity.

12 Claims, 10 Drawing Sheets

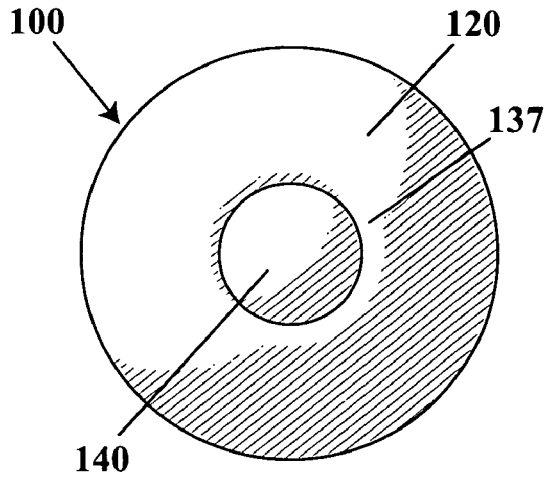
Fig. 1.1
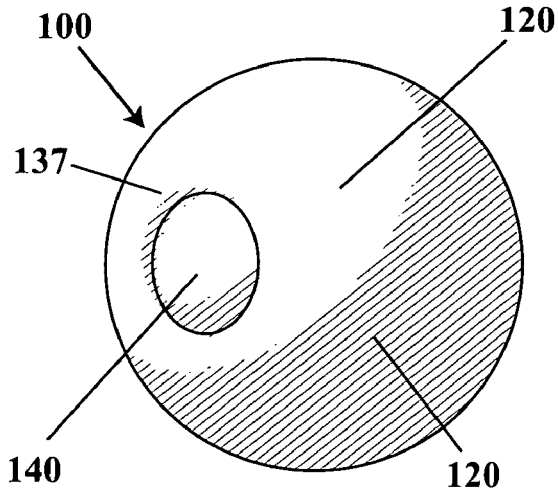
Fig. 1.2
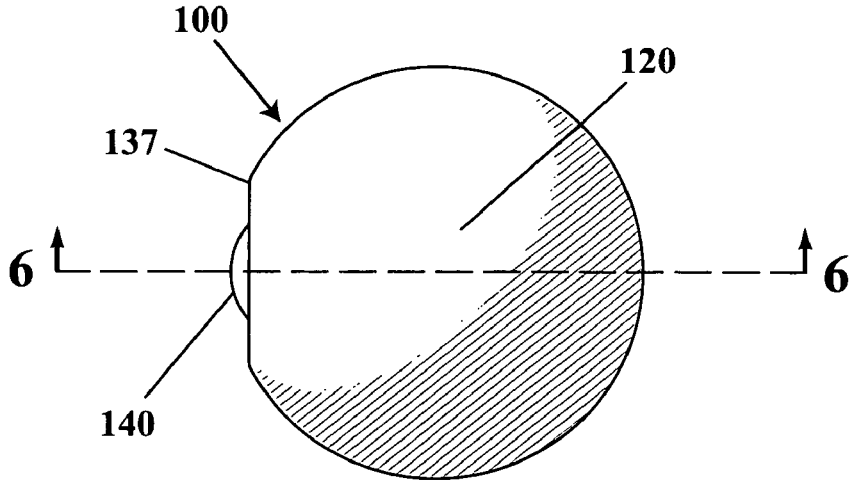
Fig. 1.3

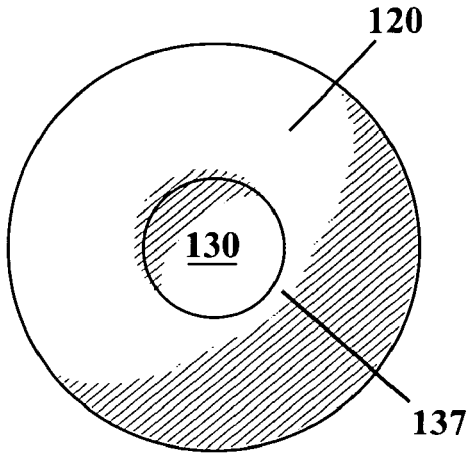
Fig. 2.1
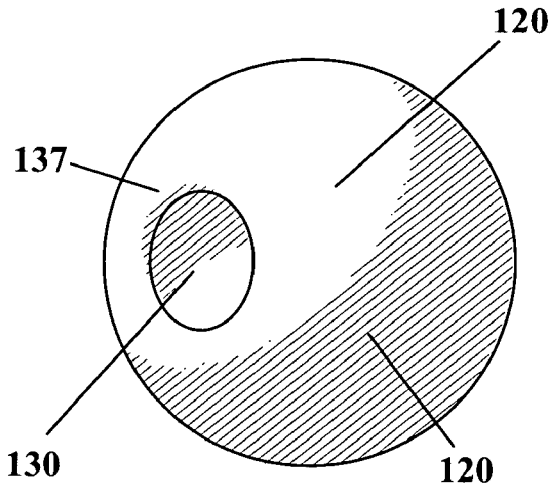
Fig. 2.2
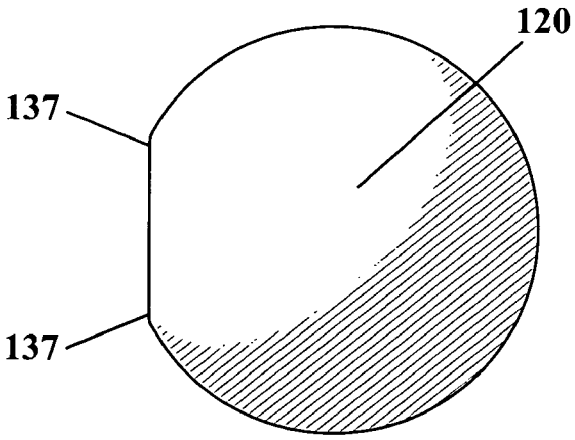
Fig. 2.3

ROLLABLE, STACKABLE TWO-PART BALL

RELATED APPLICATIONS

The present non-provisional patent application is based on and claims the priority of U.S. provisional patent application Ser. No. 60/638,307 filed Dec. 20, 2004 by Alex Hochstrasser for "Rollable, Stackable Two-Part Ball."

FIELD OF THE INVENTION

The present invention is directed to play objects, and particular play objects related to or including balls.

BACKGROUND OF THE INVENTION

For millennia, balls, and particularly spherical balls, have been one of the most popular of play objects. Balls are used in the majority of team sports and also used for a number of types of solo play. Spherical balls can be rolled, thrown, kicked, hit, etc. to provide a predictable trajectory, and are used in sports such as soccer, ping pong, basket ball, tennis, baseball, bowling, cricket, racket ball, hand ball, water polo, and polo, to name just a few, and for solo amusements such as juggling.

Clearly, balls come in a wide variety of sizes and have a wide variety of compressibility and rebound characteristics. In addition, a number of interesting ball variations into new realms (i.e., outside of simple variations in size, hardness and bounciness) are described below.

One interesting ball variation is the Koosh™ ball, manufactured by OddzOn Products of Campbell, Calif. and described in U.S. Pat. No. 4,756,529, which consists of a very large number of flexible elastomeric filaments emanating from a central region. The Koosh ball is well-suited for younger children because it does not roll away and is easily caught and grasped, in contrast with most balls and ball games which are best suited for older children and adults.

Another interesting variation on the ball is the Nobbly Wobbly™ ball, manufactured by Hands On Toys of Wilmington, Mass., which consists of bands of circular cross-section interweaved to form a ball, each of the bands being in a different equatorial plane with the arrangement of the bands having some high-order symmetry. Because of the unevenness of the surface of the Nobbly Wobbly ball, when rolled along a surface there will be a slight element of bounciness and unevenness to the roll.

The Aerobie® Squidgie® ball is a soft foam ball with a distinctive pattern of large triangular-section ridges. The pattern of the ridges gives the appearance of the ball being particularly aerodynamic when thrown in a few particular orientations. The Aerobie Squidgie ball bounces substantially true and may be played with much like a regular ball.

The Oball, manufactured by Rhino® Toys of Santa Cruz, Calif., is a spherical shell composed of roughly thirty abutting circular rings. The rings are made of a flexible plastic, and the large holes within the rings make the Oball easy to catch and clutch even for toddlers. When the Oball is rolled along a surface there will be a slight element of bounciness and unevenness to the roll.

The Iplay Light N Sound ball, manufactured by International Playthings of Parsippany, N.J., is a baby toy which emits light and sounds when rolled. The outside ball has multiple apertures through which is a colorful inner ball is visible and touchable. The inner ball is free to roll within the outer ball, but is not removable from the outer ball.

The Rubber Ball-in-Ball toy, manufactured by Leerburg® Enterprises of Menomonie, Wis., is a dog toy which has an outer ball with two paw-shaped apertures and a circular aperature. Within the outer ball is an inner ball, which is free to roll within the outer ball but is not removable from the outer ball.

The Hoberman® Sphere, manufactured by Hoberman Designs, Inc. of New York, N.Y., is a lattice of hinged arms which in its expanded or contracted states, and all states in between, is roughly spherical. When rolled in its expanded state it will generally contract to the contracted state, and will have a slight element of bounciness and unevenness to the roll.

The present invention is directed to a new ball variation which provides aspects of standard ball play and in addition opens up new play possibilities.

It is therefore an object of the present invention to provide a novel variation on the ball.

More particularly, it is an object of the present invention to provide a novel variation on the ball which allows aspects of standard ball play and in addition opens up new play possibilities.

It is therefore also an object of the present invention to provide a novel variation on ball play, particularly ball play for small children.

It is another object of the present invention to provide a multi-part ball.

It is another object of the present invention to provide a multi-part ball which can be readily assembled and disassembled.

It is another object of the present invention to provide a multi-part ball which, in assembled form, is rollable, preferably rolls relatively true, and more preferably rolls substantially true.

It is another object of the present invention to provide a multi-part ball which has a component which can be placed in stable equilibrium on a flat surface, i.e., which can oriented on a flat surface such that it does not roll.

It is another object of the present invention to provide a multi-part ball which has a component, such as a smaller ball, which rolls substantially true.

It is another object of the present invention to provide a set of multi-part balls with interchangeable parts.

It is another object of the present invention to provide a set of multi-part balls with components which are stackable, and preferably easily stackable.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE PRESENT INVENTION

The present invention is directed to a toy having a larger ball with a spherical-section surface cavity, and a smaller ball. The surface cavity of the larger ball has a radius of curvature substantially equal to the radius of the smaller ball, and the mouth of the cavity is flexible so as to allow the smaller ball to be inserted into, retained within and removed from the surface cavity of the larger ball. When in the cavity, the smaller ball extends beyond the mouth of the cavity to an extent that the defining sphere of the larger ball roughly meets the outermost point of the smaller ball. (This allows the assembled pair to roll relatively true.)

BRIEF DESCRIPTION OF THE FIGURES

The accompanying figures, which are incorporated in and form a part of this specification, illustrate embodiments of the invention and, together with the description given above and the detailed description of the preferred embodiments given below, serve to explain the principles of the invention.

FIG. 1.1 shows a view of the two-part ball of the present invention with the smaller ball positioned in the cavity of the larger ball.

FIG. 1.2 shows the two-part ball of FIG. 1.1 rotated by 45° about an axis through the center of the ball and extending from the bottom to the top of the page.

FIG. 1.3 shows the two-part ball of FIG. 1.1 rotated by 90° about an axis through the center of the ball and extending from the bottom to the top of the page.

FIG. 2.1 shows a view directly into the cavity of the larger ball of the two-part ball of the present invention.

FIG. 2.2 shows the larger ball of FIG. 2.1 rotated by 45° about an axis through the center of the ball and extending from the bottom to the top of the page.

FIG. 2.3 shows the larger ball of FIG. 2.1 rotated by 90° about an axis through the center of the ball and extending from the bottom to the top of the page.

DETAILED DESCRIPTION OF THE PREFERRED EMBODIMENTS

Figure 5:
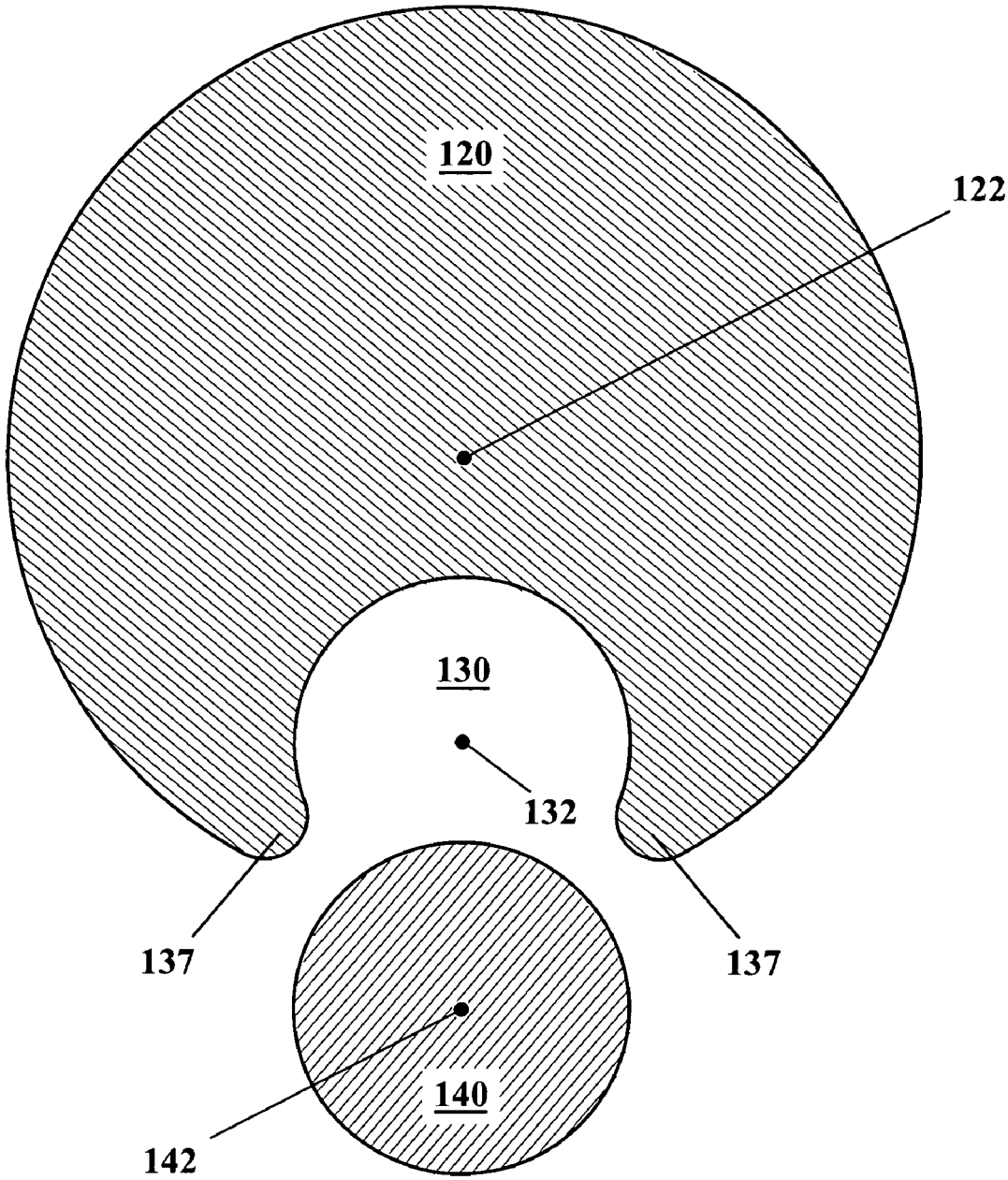
FIG. 5 shows a cross-sectional view of the two-part ball of the present invention with the smaller ball outside the cavity of the larger ball.

As shown in the perspective views of FIGS. 1.1, 1.2, 1.3, 2.1, 2.2, 2.3 and 3, the play object of the present invention (100) is a two-part ball comprising a larger ball (120) having an open, substantially spherical-section (i.e., the volume formed by a sphere cut by a plane) cavity (130) into which a smaller ball (140) may be removably inserted. The two-part ball (100) is shown in disassembled form in cross-section in FIG. 5 on a plane which passes through the center (122) of the larger ball (120), a central point (132) of the substantially spherical-section cavity (130), and the center (142) of the smaller ball (140), with the smaller ball (140) outside the cavity (130), i.e., in a disassembled state. (It should be noted that although the larger ball (120) and the assembled two-part ball (100) are not strictly spherical, for ease of discussion they are both referred to as balls.)

Figure 3:
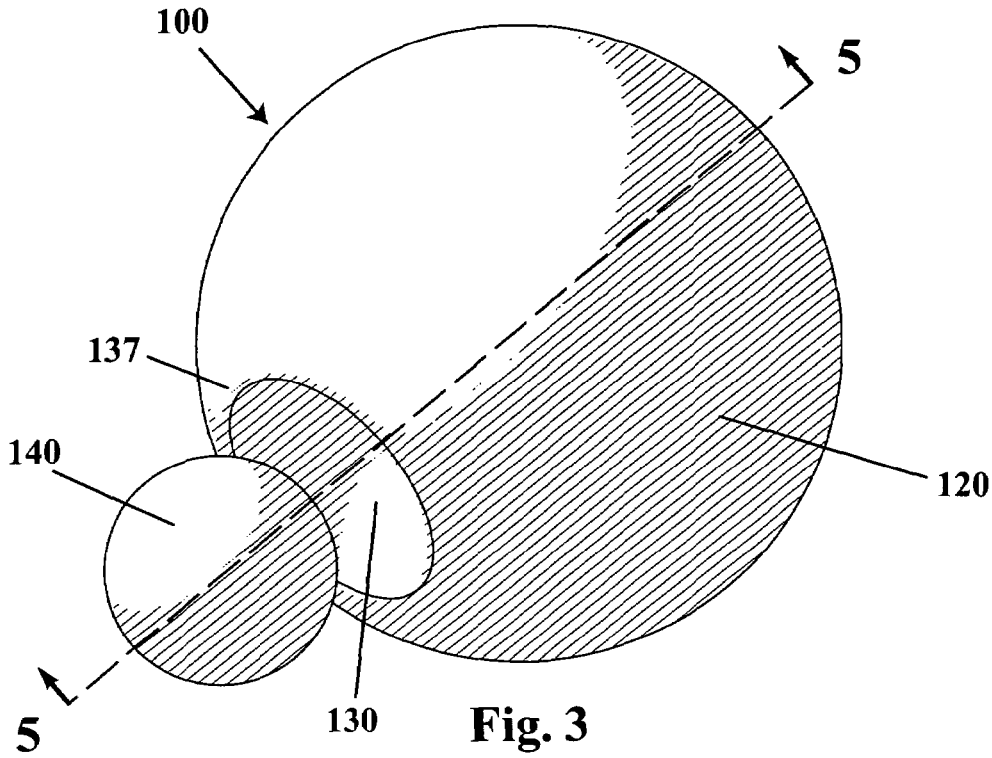
FIG. 3 shows a view of the two-part ball of the present invention with the smaller ball outside the cavity of the larger ball.
Figure 4:
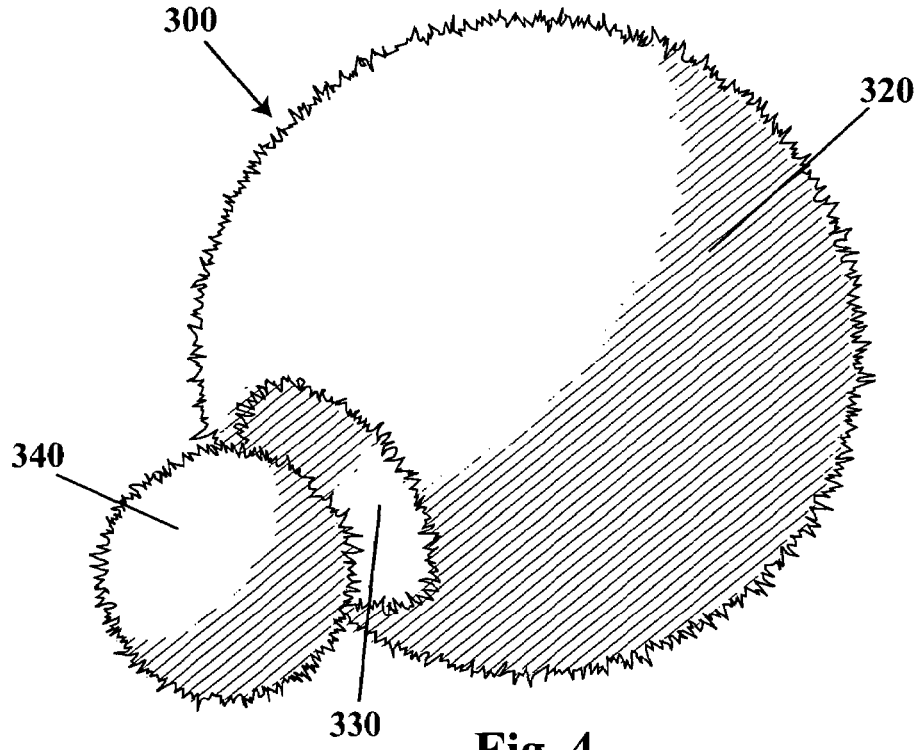
FIG. 4 shows an alternate embodiment of two-part ball of the present invention with the smaller ball outside the cavity of the larger ball, where both balls are furry.
Figure 6:
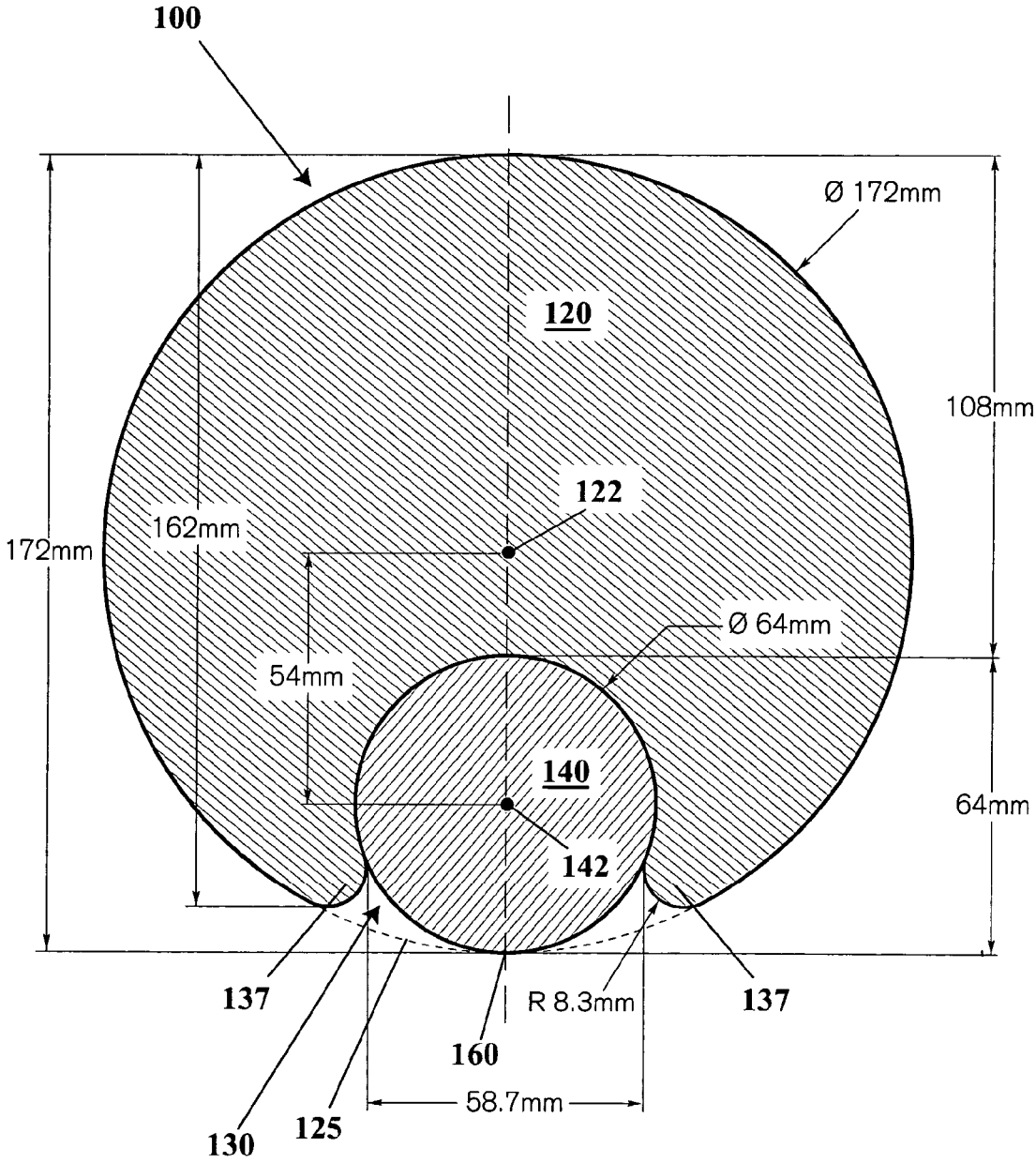
FIG. 6 shows a cross-sectional view, with preferred dimensions specified, of the two-part ball of the present invention with the smaller ball inside the cavity of the larger ball.

In FIG. 6 the two-part ball (100) is shown in assembled form in cross-section on a plane which passes through the center (122) of the larger ball (120), a central point (132) of the substantially spherical-section cavity (130), and the center (142) of the smaller ball (140), with the smaller ball (140) inside the cavity (130) and the preferred dimensions specified in millimeters. In particular, according to the preferred embodiment of the present invention, the larger ball (120) has a radius of 86 mm (i.e., a diameter of 172 mm), the smaller ball (140) has a diameter of 64 mm, the distance between the center (122) of the larger ball (120) and the center (142) of the smaller ball (140) with the two-part ball in assembled form is 54 mm, the lip (137) of the cavity (130) has a diameter of 58.7 mm at its narrowest, and the radius of curvature of the depicted cross-section of the lip (137) of the cavity (130) is 8.3 mm. (According to the preferred embodiment, the cavity (130) is large enough that a child may insert his or her first to use the larger ball (120) as a boxing glove.) It is important to note that the smaller ball (140) meets the defining sphere (125) of the larger ball (120) (i.e., the extension across the cavity (130) of the spherical surface of the larger ball (120)) at a point (160). This allows the two-part ball (100) to roll substantially true (i.e., straight) on a smooth, flat surface when assembled, i.e., when the smaller ball (140) is in the cavity of the larger ball (120). The larger ball (120) and/or the smaller ball (140) are/is made of a flexible or compressible material, preferably an integral-skin polyurethane foam, of sufficient malleability to allow the smaller ball (140) to be easily removed from and inserted into the cavity (130) of the larger ball (120) by a child or a person of limited manual dexterity. In addition to the smaller ball (140) having sufficient malleability, the surface texture of the smaller ball (140) must provide enough friction so as to allow it (140) to be easily gripped by the fingers of a child. According to the preferred embodiment, the smaller ball (140), in comparison with the larger ball (120), is made of a foam with a slower return when deformed. According to the preferred embodiment, the larger ball (120), in comparison with the smaller ball (140), is made of a foam that is a bit harder and has more bounce. In an alternate embodiment, rather than being fabricated from polyurethane foam, the larger ball (120) and/or the smaller ball (140) are/is made of a natural rubber foam, which may have a velvet-like skin. In another alternate embodiment (300) depicted in FIG. 4, the larger ball (320) and smaller ball (340) have furry surfaces, the cavity (330) may also have a furry surface, and the larger ball (320), smaller ball (340) and cavity (330) have roughly the same dimensions as the larger ball (120), smaller ball (140) and cavity (130) of the embodiment (100) depicted in FIG. 3.

Figure 8:
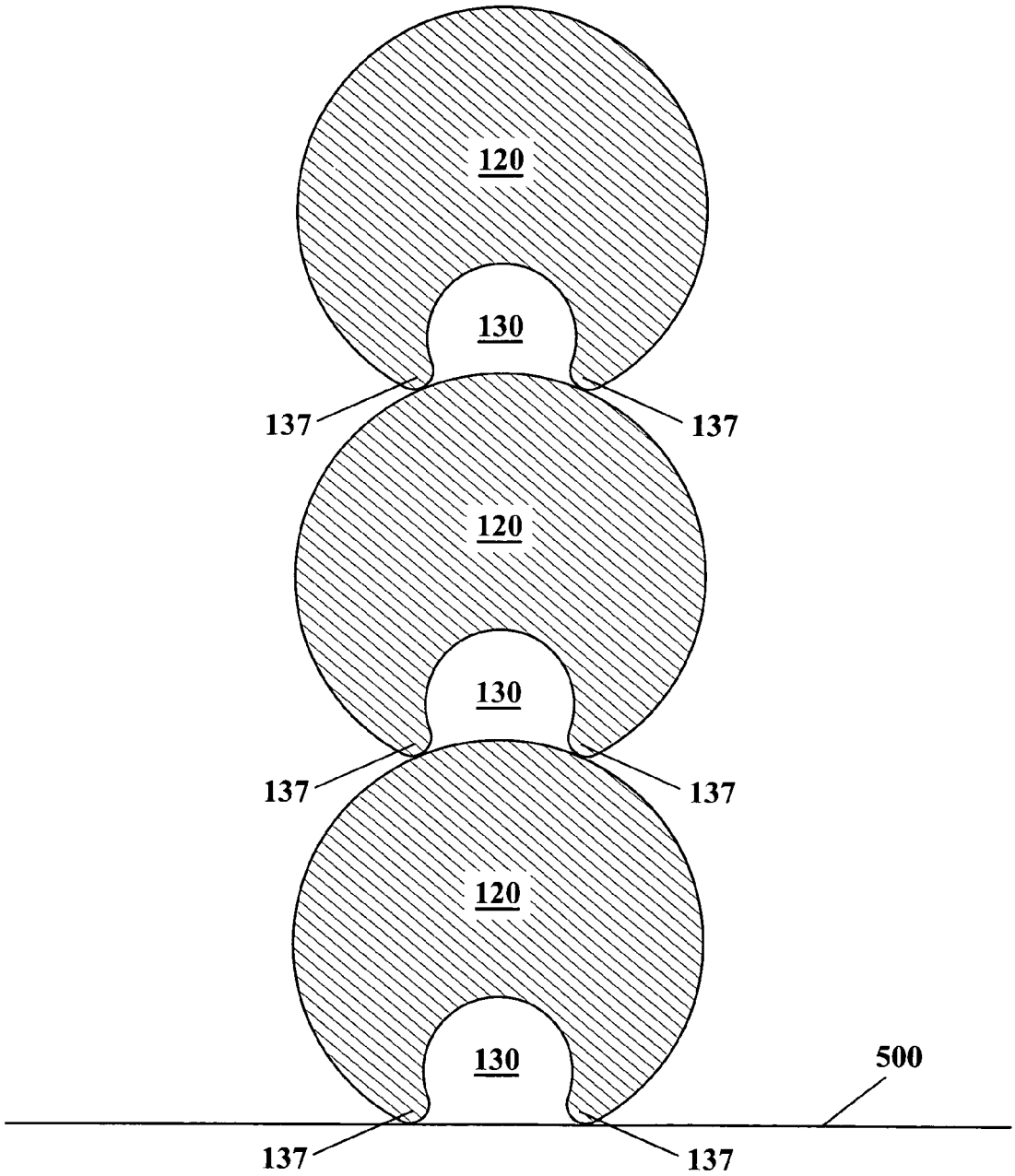
FIG. 8 is a cross-sectional view illustrating how, with the smaller balls removed from the cavities of the larger balls, multiple larger balls can be stacked.

The above-specified dimensions are chosen to optimize the compromise between decreasing the size of the smaller ball (140) to obtain truer rolling of the assembled two-part ball (100), and increasing the size of the smaller ball (140) and/or the lip (137) of the cavity (130) to: (i) facilitate ease of removing and inserting the smaller ball (140) from/into the cavity (130), (ii) provide a stable equilibrium when the larger ball (120) (with the smaller ball (140) not in the cavity (130))

is put on a flat surface with the lip (137) of the cavity (130) against the flat surface, and (iii) facilitate stacking in the geometry shown in FIG. 8.

According to the present invention, the ratio of the radius of the defining sphere (125) of the larger ball (120) to the radius of the smaller ball (140) is 2.7, the ratio of the distance between the center (122) of the defining sphere of the larger ball (120) and the center (142) of the defining sphere of the cavity (130) (i.e., the center (142) of the smaller ball (140) when in the cavity (130)) to the radius of the smaller ball (140) is 1.7, the ratio of the radius of the mouth (137) of the cavity (130) at its narrowest to the radius of the smaller ball (140) is 0.9, and the ratio of the radius of curvature of the rounding of the lip (137) of the cavity (130) to the radius of the lip (137) of the cavity (130) at its narrowest is 0.3. Preferably one or more of the aforementioned dimensionless ratios hold to ±30%, more preferably one or more of the aforementioned dimensionless ratios hold to ±20%, still more preferably one or more of the aforementioned dimensionless ratios hold to ±10%, still more preferably one or more of the aforementioned dimensionless ratios hold to ±7%, still more preferably one or more of the aforementioned dimensionless ratios hold to ±5%, even still more preferably one or more of the aforementioned dimensionless ratios hold to ±2.5%, and still more preferably one or more of the aforementioned dimensionless ratios hold to ±1%.

Figure 7A:
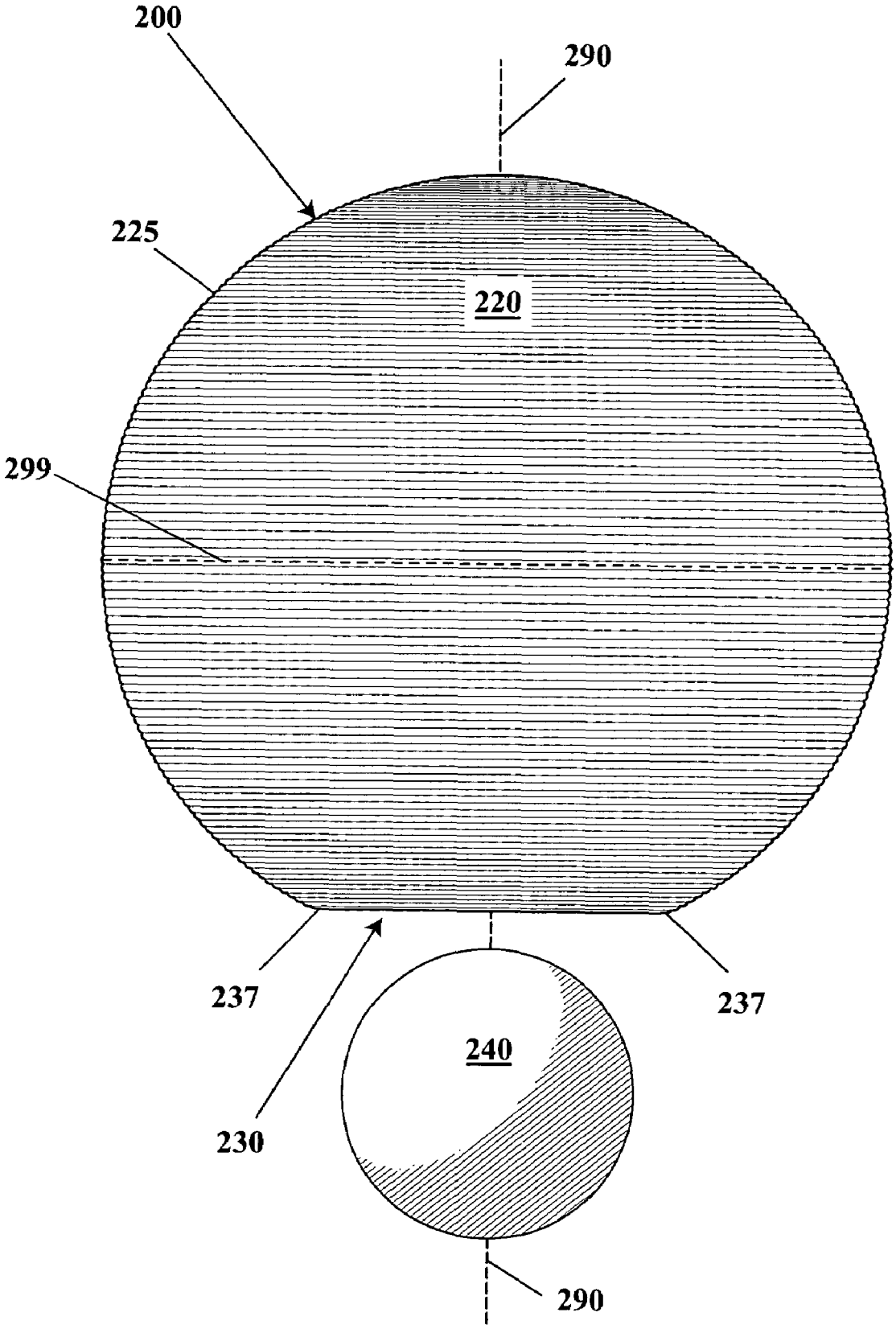
FIG. 7A show an alternate embodiment of two-part ball of the present invention with the smaller ball outside the cavity of the larger ball, where the larger ball is ribbed.
Figure 7B:
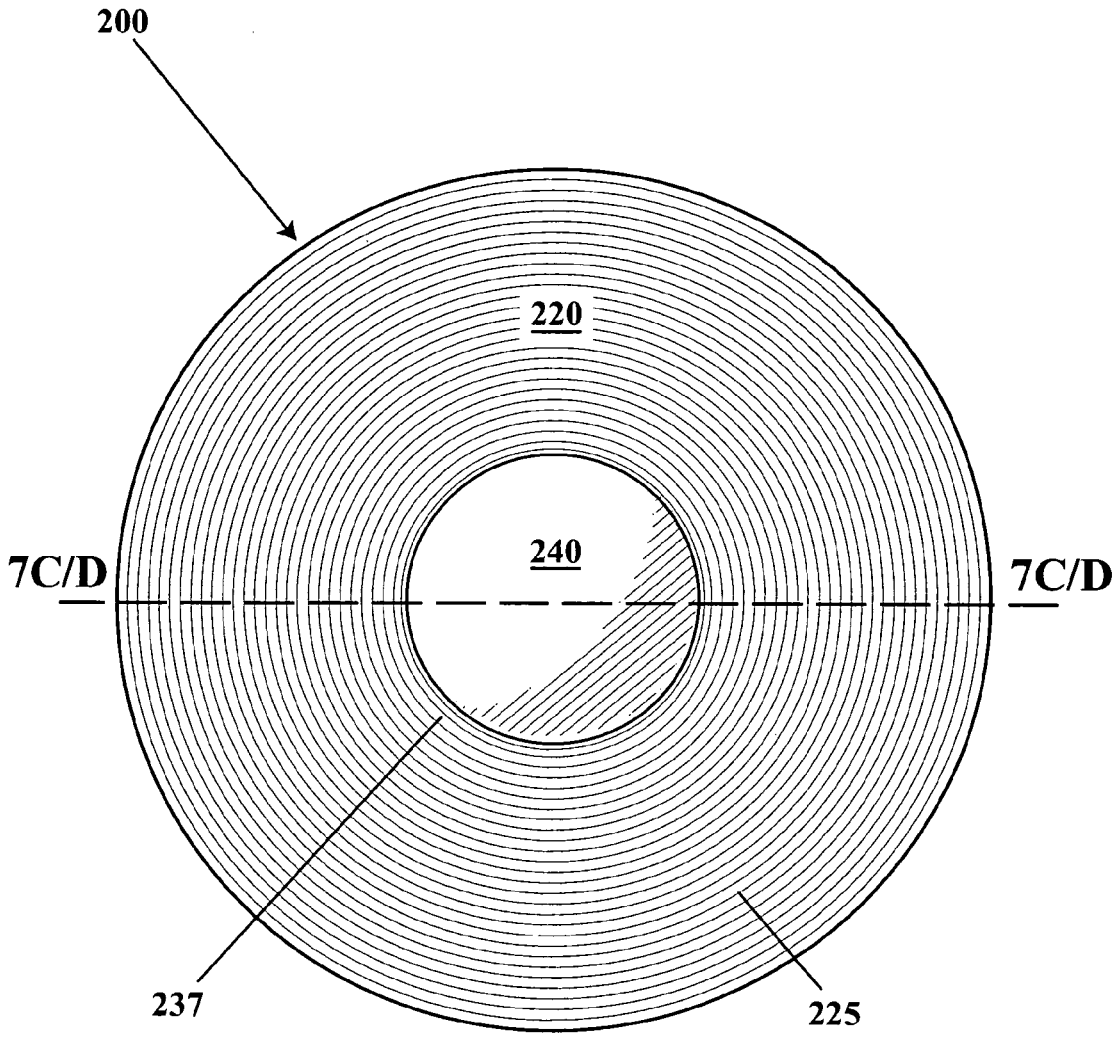
FIG. 7B shows the two-part ball of FIG. 7A with the smaller ball positioned in the cavity of the larger ball.
Figure 7C:
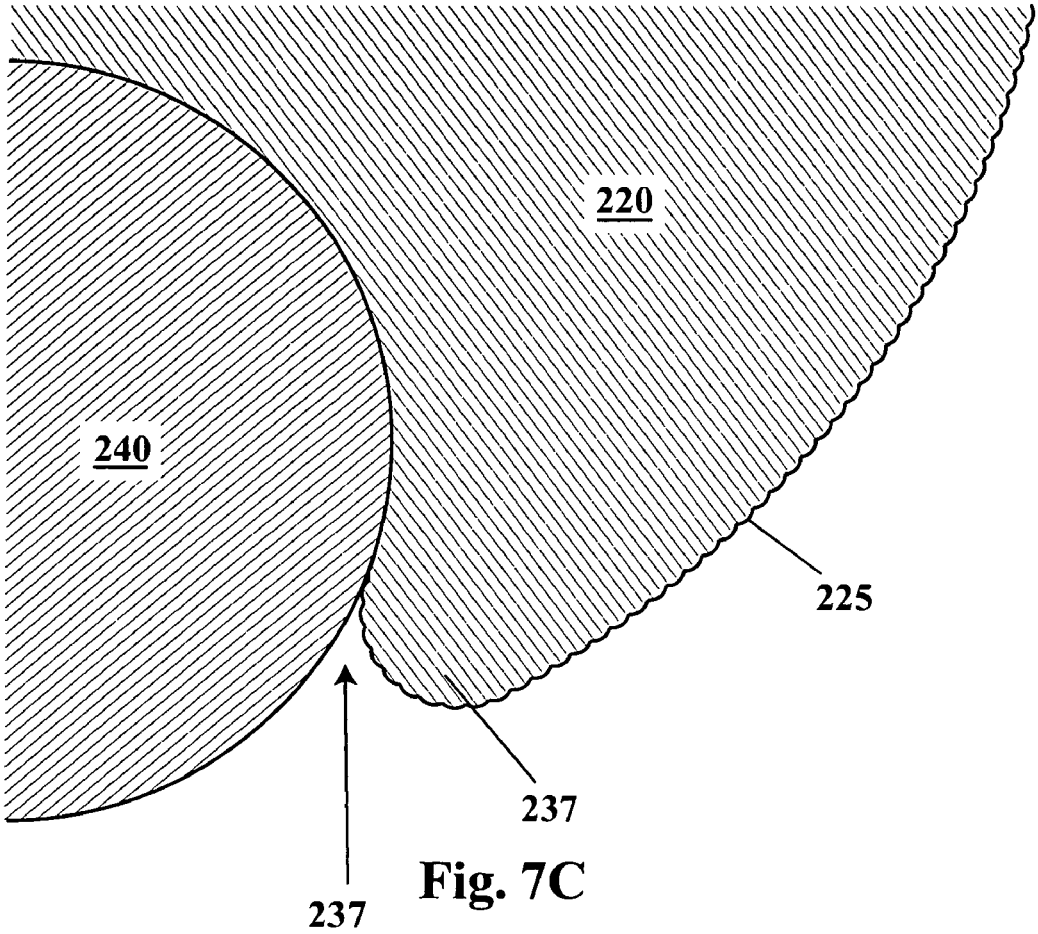
FIG. 7C shows a close-up cross-section of the two-part ball of FIG. 7B in a region including roughly half the smaller ball and a portion of the ribbed surface of the larger ball.
Figure 7D:
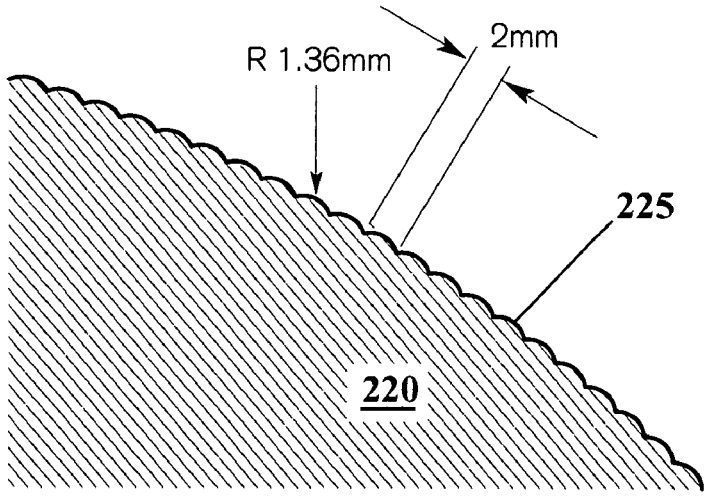
FIG. 7D shows a close-up cross-section, with preferred dimensions specified, of the ribbed surface of the two-part ball of FIG. 7A.

An alternate embodiment of the present invention is a two-part ball (200) shown in FIGS. 7A, 7B, 7C and 7D where the larger ball (220) has latitudinal ribbing (225) on its surface, i.e., if the cavity (230) is considered to be centered along a polar axis (290), the ribs (225) are parallel to the equator (299). The ribbing (225) covers the exterior spherical surface, as shown in FIGS. 7A and 7B, and, as shown in the close-up cross-section of FIG. 7C, the ribbing (225) continues along the rounded lip (237) of the cavity (230) to where the lip (237) meets the smaller ball (240) when the smaller ball (240) is positioned in the cavity (230). According to the preferred embodiment of the present invention, as shown in FIG. 7D the ribbing (225) has ridges with a radius of curvature of 1.36 mm and a width of 2 mm. The preferred overall dimensions of the smaller ball (240) and the larger ball (220) are substantially the same as those depicted in FIG. 6. The ribbing (225) provides the advantage of further stabilizing the stacking geometry shown in FIG. 8, as well as slightly roughening the rolling of the assembled two-part ball (200) to obscure defects in the trueness of the rolling which occurs when the non-spherical portion of its surface which occurs at the lip (237) of the cavity (230) contacts the rolled-upon surface.

Figure 9:
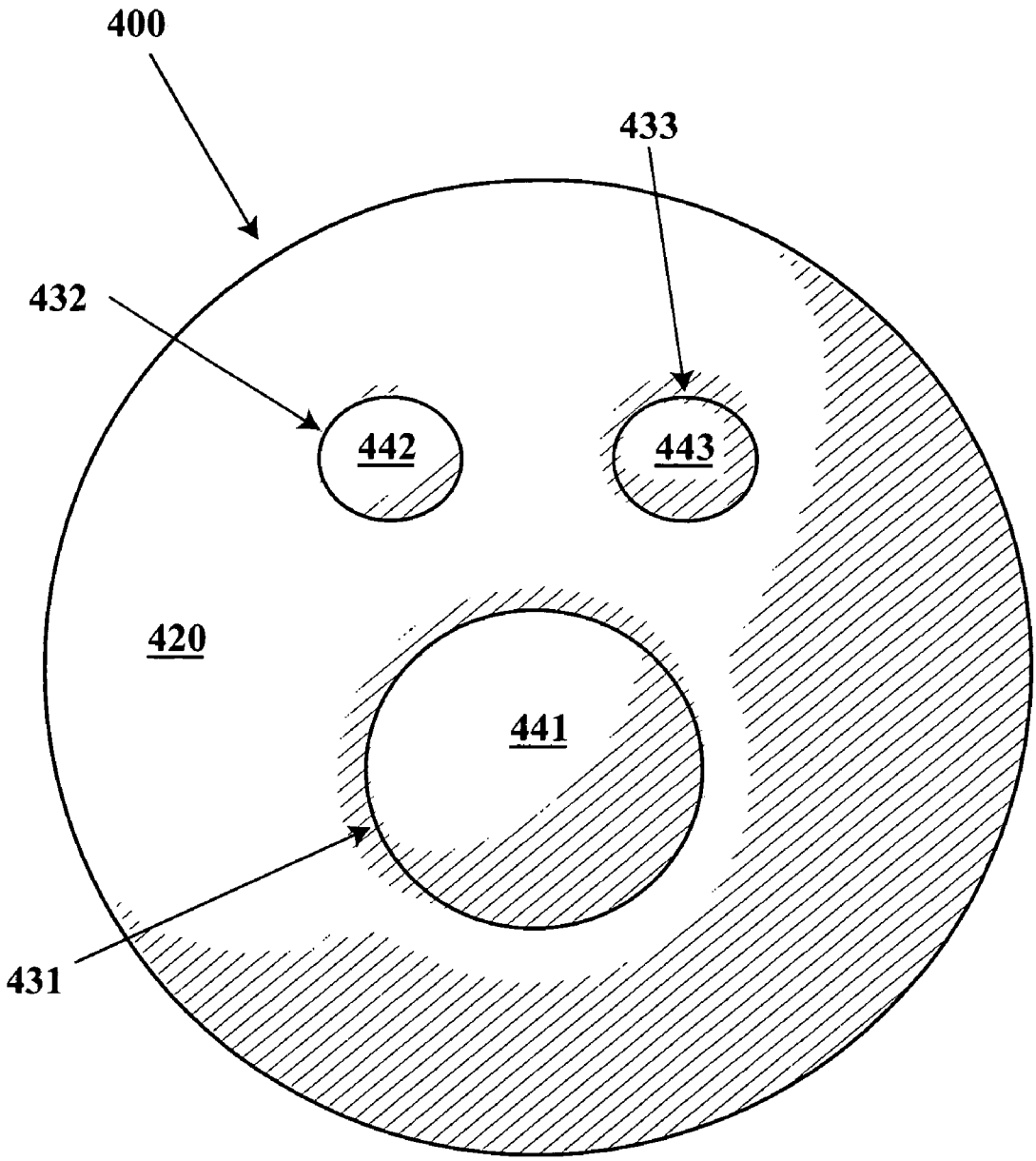
FIG. 9 shows an alternate embodiment of the present invention which is a multi-part ball consisting of one large ball with multiple cavities into which smaller balls may be removably inserted.

In another alternate embodiment depicted in FIG. 9, the play object is a multi-part ball (400) comprising a larger ball (420) which has multiple cavities, three cavities (431), (432) and (433) in the embodiment depicted, into which smaller balls (441), (442) and (443) may be inserted and removed. In the preferred embodiment, the first smaller ball (441), the first cavity (431), and the larger ball (420 have dimensions equal to those of the first embodiment (100) whose dimensions are provided in FIG. 6, and the preferred ranges of dimensions are as described above for the first embodiment (100). Preferably, the ratio is size of the first smaller ball (441) to the second or third smaller ball (442) or (443) is 0.33±30%, more preferably 0.33±20%, still more preferably 0.33±10%, and still more preferably 0.33±5%. However, smaller balls of any sizes are considered to be within the scope of the present invention.

The foregoing descriptions of specific embodiments of the present invention have been presented for purposes of illustration and description. They are not intended to be exhaustive or to limit the scope of the invention to the precise forms disclosed, and it should be understood that modifications and variations are possible in light of the above teaching. Of the many variations within the scope of the present invention, some examples are: the balls may have textures other than those described; the dimensions or ratios of dimensions of the diameter of the larger ball, the diameter of the smaller ball, the radius of curvature at the lip of the cavity, the distance between the center of the cavity and the center of the larger ball, the curvature and width of the ribbings, or any other dimensions may have values other than as described; the play object may consist of multiple larger balls and multiple smaller balls, possibly having a variety of colors; the play object may include more than two components, such as one or more additional smaller balls, possibly having a variety of sizes, which are insertable into one or more cavities in the larger ball, or into one or more cavities in one or more of the smaller balls; etc. It should also be noted that the terms "substantially" and "roughly" are generally used in the present specification and claims in the sense of permitting or maintaining the described functionality of the two-part ball of the present invention. For instance, a ball is "substantially" spherical if it rolls substantially true, or the spherical cavity has "roughly" the same diameter as that of the smaller ball if the smaller ball fits snugly in the cavity.

In summary, it is intended that the scope of the invention be defined by the following claims and their equivalents.

What is claimed is:

1. A toy comprising:

a first substantially spherical smaller ball having a first radius; and a second larger ball having a substantially spherical-section surface cavity with a first defining sphere having a second radius roughly equal to said first radius, said larger ball being, with the exception of said surface cavity, substantially spherical with a second defining sphere having a third radius greater than said first and second radii, the mouth of said cavity having an aperture radius and being flexible to allow insertion, retention and removal of said smaller ball into, within, and from, respectively, said surface cavity, the center of said first defining sphere being offset from said second defining sphere by an offset distance, said smaller ball, when in said cavity, extending beyond said mouth of said cavity roughly to said second defining sphere, when said smaller ball is not within said surface cavity, said larger ball is placeable in a stable equilibrium on a horizontal surface with the mouth of said cavity in contact with said horizontal surface, and when said smaller ball is located in said cavity of said larger ball and the combination is rolled, the combination rolls relatively true.

2. The toy of claim 1 wherein a first ratio of said third radius to said first radius is 2.7±20%, a second ratio of said offset distance to said first radius is 1.7±20%, and a third ratio of said aperture radius to said first radius is 0.9±7%.

3. The toy of claim 1 wherein a first ratio of said third radius to said first radius is 2.7±10%, a second ratio of said offset distance to said first radius is 1.7±10%, and a third ratio of said aperture radius to said first radius is 0.9±5%.

4. The toy of claim 1 wherein a first ratio of said third radius to said first radius is 2.7±5%, a second ratio of said offset distance to said first radius is 1.7±5%, and a third ratio of said aperture radius to said first radius is 0.9±5%.

5. The toy of claim 1 wherein a first ratio of said third radius to said first radius is 2.7±2.5%, a second ratio of said offset distance to said first radius is 1.7±2.5%, and a third ratio of said aperture radius to said first radius is 0.9±2.5%.

6. The toy of claim 1 wherein the entirety of said larger ball is made of a first flexible material.

7. The toy of claim 6 wherein said smaller ball is made of a second flexible material.

8. The toy of claim 7 wherein said first and second flexible materials are foams.

9. The toy of claim 7 wherein said first smaller ball, in comparison with said second larger ball, is made of a material which has a slower return when deformed.

10. The toy of claim 7 wherein said second larger ball, in comparison with said first smaller ball, is made of a material which is harder.

11. The toy of claim 7 wherein said second larger ball, in comparison with said first smaller ball, is made of a material which has more bounce.

12. The toy of claim 7 wherein said first flexible material is the same as said second flexible material.

* * * * *